US005595114A

United States Patent [19]

Negishi et al.

[11] Patent Number: 5,595,114

[45] Date of Patent: Jan. 21, 1997

[54] STENCIL PRINTING DRUM HAVING SQUEEGEE AND DOCTOR ROLLER END INK BANKS

[75] Inventors: Hideo Negishi; Yoshiharu Ohinata, both of Tokyo, Japan

[73] Assignee: Riso Kagaku Corporation, Tokyo, Japan

[21] Appl. No.: 407,379

[22] Filed: Mar. 20, 1995

[30] Foreign Application Priority Data

Mar. 22, 1994 [JP] Japan ..... 6-050593

[51] Int. Cl.[6] ..... B41L 13/18; B41F 15/46

[52] U.S. Cl. ..... 101/120; 101/119

[58] Field of Search ..... 101/114, 116, 101/119, 120

[56] References Cited

U.S. PATENT DOCUMENTS 4,989,509 2/1991 Zimmer ..... 101/120

FOREIGN PATENT DOCUMENTS 192634 10/1985 Japan ..... 101/120

OTHER PUBLICATIONS

Patent Abstracts of Japan vol. 009 No. 333 (M–443), 27, Dec. 1985.

Patent Abstracts of Japan vol. 009 No. 313 (M–437), 10 Dec. 1985.

Patent Abstracts of Japan vol. 009 No. 224 (M–331), 13 Oct. 1984.

*Primary Examiner*—Stephen R. Funk

*Attorney, Agent, or Firm*—Sughrue, Mion, Zinn, Macpeak & Seas

[57] ABSTRACT

A stencil printing machine comprises: a rotary cylindrical drum having an ink passage part; an ink supplying roller rotatable around an axis in parallel with the central axis of the rotary cylindrical drum, the ink supplying roller being brought into contact with the inner cylindrical surface of the rotary cylindrical drum; a pair of cylindrical protrusions on both ends of the ink supplying roller, the cylindrical protrusions being smaller in outside diameter than the ink supplying roller and coaxial with the ink supplying roller; an ink coating roller arranged in parallel with the ink supplying roller, the ink coating roller applying ink onto the surface of the ink supplying roller in accordance with the ink supplying roller turning, an ink pool forming between the ink coating roller and the ink supplying roller; and a pair of ink banks are provided at both ends of the ink pool, respectively, the ink banks having sloped surfaces in contact with the cylindrical surfaces of the cylindrical protrusions, the sloped surfaces for leading the ink into the ink pool when ink leaks onto the cylindrical protrusions.

5 Claims, 2 Drawing Sheets

STENCIL PRINTING DRUM HAVING SQUEEGEE AND DOCTOR ROLLER END INK BANKS

BACKGROUND OF THE INVENTION

1. Field of Invention

This invention relates to a stencil printing machine, and more particularly to a stencil printing drum in a stencil printing machine.

2. Description of Related Art

A conventional ordinary stencil printing drum comprises: a rotary cylindrical drum having an ink passage part; an ink supplying roller which is provided inside the rotary cylindrical drum in such a manner that it is brought in contact with the inner cylindrical surface of the rotary cylindrical drum; and an ink coating roller for supplying ink to the ink supplying roller. The ink supplying roller is so arranged that it is rotatable around an axis in parallel with the central axis of the rotary cylindrical drum and is brought into contact with the inner cylindrical surface of the rotary cylindrical drum. The ink coating roller is in parallel with the ink supplying roller, thus forming an ink pool between them. That is, the ink coating roller is adapted to coat the surface of the ink supplying roller with ink.

When ink is supplied to the inner cylindrical surface of the rotary cylindrical drum by the ink supplying roller, part of the ink thus supplied may leak out from both ends of the ink supplying roller, and run to the inner cylindrical surface of the rotary cylindrical drum. In order to overcome this difficulty, a spatula-shaped plate member is provided inside the rotary cylindrical drum in such a manner that it is in contact with the inner cylindrical surface of the rotary cylindrical drum. That is, the ink thus run is returned by the spatula-shaped plate member to the ink coating part of the inner cylindrical surface of the rotary cylindrical drum where the ink supplying roller coats the ink.

However, it is rather difficult to determine the contact pressure and the contact angle between the spatula-shaped plate member and the inner cylindrical surface of the rotary cylindrical drum. Hence, it is also difficult for the spatula-shaped plate member to return all of the ink to the ink coating part of the inner cylindrical surface of the rotary cylindrical drum. The ink which is not caught by the spatula-shaped plate member may flow out of the printing drum to stain the printing machine or the printing sheets. In addition, the spatula-shaped plate member is worn out soon being held in contact with the inner cylindrical surface of the rotary cylindrical drum at all times.

SUMMARY OF THE INVENTION

The present invention provides a stencil printing machine comprising: a rotary cylindrical drum having an ink passage part; an ink supplying roller rotatable around an axis in parallel with the central axis of the rotary cylindrical drum, the ink supplying roller being brought into contact with the inner cylindrical surface of the rotary cylindrical drum; a pair of cylindrical protrusions on both ends of the ink supplying roller, the cylindrical protrusions being smaller in outside diameter than the ink supplying roller and coaxial with the ink supplying roller; an ink coating roller arranged in parallel with the ink supplying roller, the ink coating roller applying ink onto the surface of the ink supplying roller in accordance with the ink supplying roller turning, an ink pool forming between the ink coating roller and the ink supplying roller; and a pair of ink banks are provided at both ends of the ink pool, respectively, the ink banks having sloped surfaces in contact with the cylindrical surfaces of the cylindrical protrusions, the sloped surfaces for leading the ink into the ink pool when ink leaks onto the cylindrical protrusions.

Ink may leak onto the cylindrical protrusions of the ink supplying roller; however, it is led into the ink pool located between the ink banks by means of the sloped surfaces of the ink banks as the ink supplying roller turns.

DETAILED DESCRIPTION OF THE PREFERRED EMBODIMENTS

The invention will be described with reference to its preferred embodiment shown in FIGS. 1 through 5.

Figure 1:
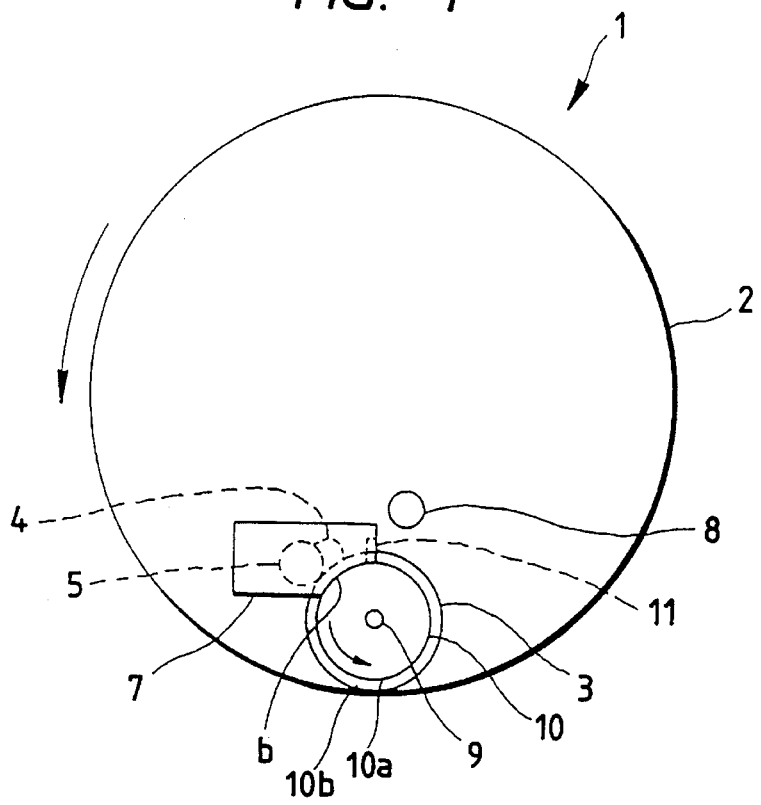
FIG. 1 is an explanatory side view showing the arrangement of a stencil printing drum according to the present invention.
Figure 2:
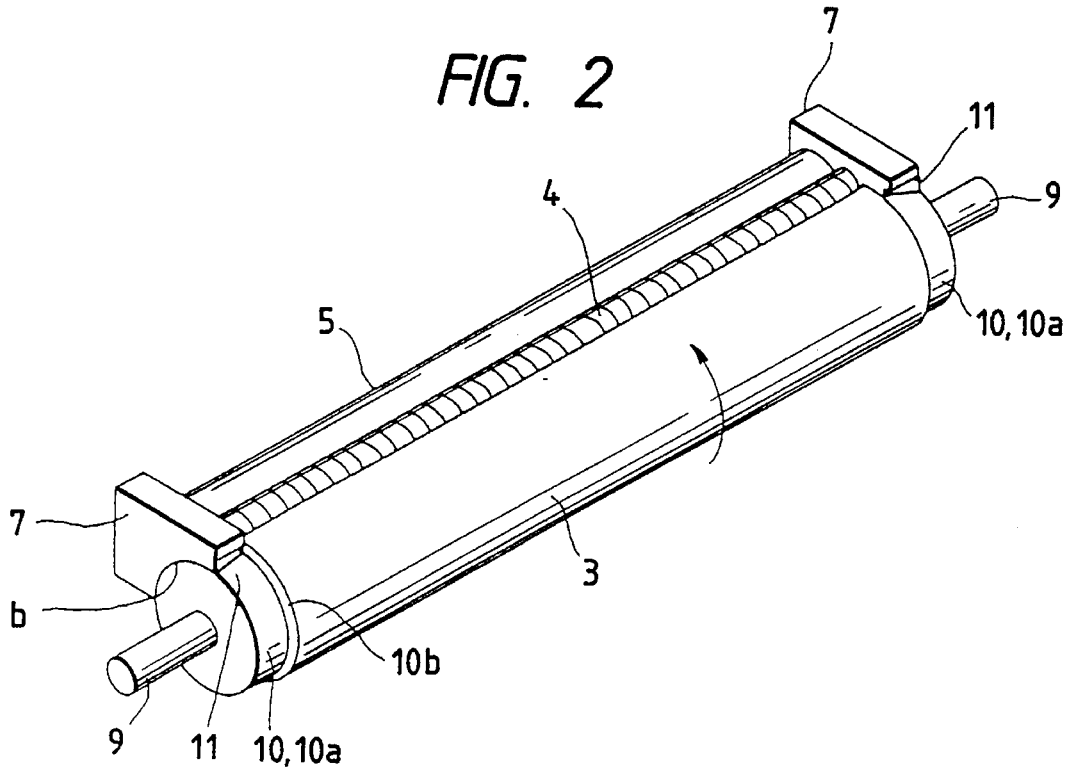
FIG. 2 is a perspective view showing the stencil printing drum for a description of the behavior of ink in the stencil printing drum of the invention.

FIG. 1 shows a stencil printing drum 1 with a rotary cylindrical drum 2 having an ink passage part. An ink supplying roller 3 is provided inside the rotary cylindrical drum 2. The ink supplying roller 3 is so designed that it is rotatable around a rotary shaft 9 which is in parallel with the central axis of the rotary cylindrical drum 2 and is brought into contact with the inner cylindrical surface of the rotary cylindrical drum 2. The printing drum 1 is turned counterclockwise in FIG. 1. The rotary cylindrical drum 2 is made of a porous plate or screen having a number of pores. A stencil sheet (riot shown) is wound on the tubular wall of the rotary cylindrical drum 2 with its front edge being clamped with a clamping device provided on the drum 2.

An ink coating roller 5 is provided inside the rotary cylindrical drum 2. The ink coating roller 5 is positioned on the left side of the ink supplying roller 3 turning counterclockwise in FIG. 1 in such a manner that it is in parallel with the ink supplying roller 3, and is adjacent to the latter 3. The ink coating roller 5 is to supply ink 4 from an ink pool (described later) to the ink supplying roller 3.

In FIG. 1, reference numeral 8 designates an ink distributor which is adapted to send the ink, which is supplied by ink supplying means (not shown), to the space between the ink supplying roller 3 and the ink coating roller 5, to form the ink pool between those rollers 3 and 5.

A pair of cylindrical protrusions 10 are extended from both ends of the ink supplying roller 3, respectively, in such a manner that the cylindrical protrusions 10 are coaxial with the ink supplying roller 3. Those cylindrical protrusions 10 are smaller in outside diameter than the ink supplying roller 3 and have a width a. In addition, a pair of ink banks 7 are provided at both ends of the ink supplying roller 3, respectively, in such a manner as to have the ink pool between them.

The ink banks 7 are each substantially in the form of a rectangular box having a first surface which is an inwardly curved guide surface b at a corner. The ink banks 7 are combined with the ink supplying roller 3 in such a manner that the guide surfaces b of the ink banks 7 are brought in contact with the cylindrical surfaces 10*a* of the cylindrical protrusions 10 from above, and parts c of the ink banks 7 are in contact with the side surfaces 10*b* of the ink supplying roller 3, respectively.

Figure 3:
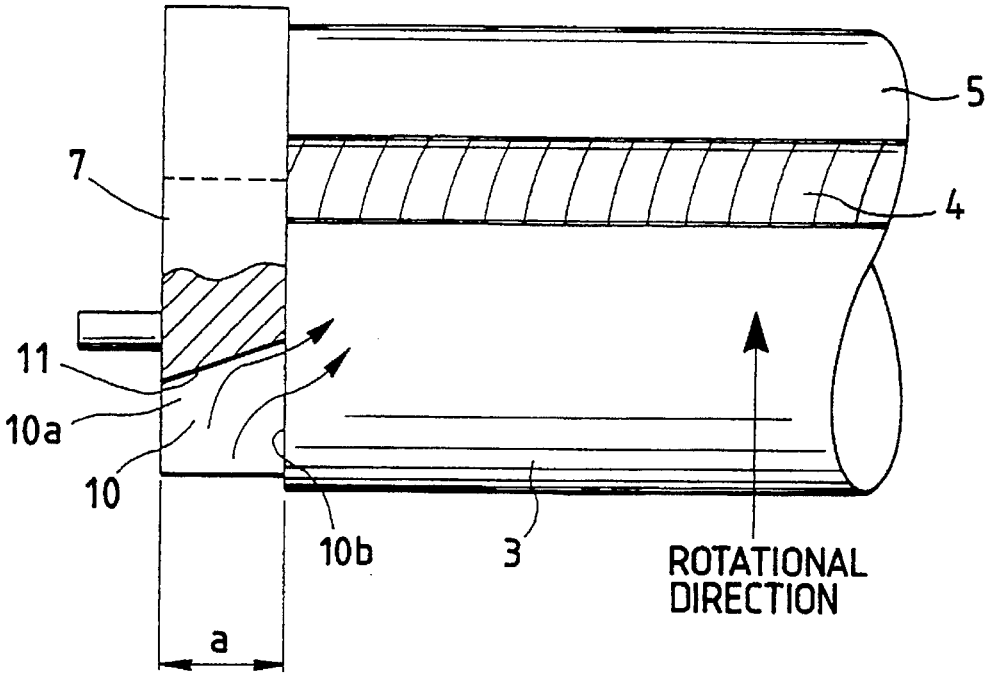
FIG. 3 is a plan view showing a cylindrical protrusion extended from an ink supplying roller shown in FIG. 2.
Figure 4:
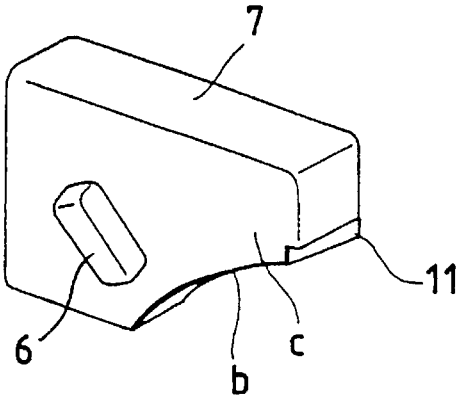
FIG. 4 is a perspective view of an ink bank in the stencil printing drum of the invention.

The upper end portion of the guide surface b of each of the ink banks 7 is formed into a second surface which is a sloped surface 11 which is used to lead the ink from the cylindrical protrusion 10 to the ink pool. The sloped surface 11, as shown in FIG. 3, is inclined so that, as viewed in the direction of the straight arrow, it is recessed into the ink bank such that the depth of the recess increases towards the side surface 10*b* of the ink supplying roller 3. Further, the sloped surface 11 extends above the outer cylindrical surface of the ink supplying roller 3.

Hence, as the ink supplying roller 3 turns, the ink which has leaked onto the cylindrical protrusions 10 is caught and led by the sloped surfaces 11 of the ink banks 7, so that it is returned towards the middle of the ink supplying roller 3.

In order to adjust the space between the ink supplying roller 3 and the ink coating roller 5, the ink banks 7 have elongated grooves 6 in their inner surfaces which movably hold both end portions of the ink coating roller 5. The distance between the ink coating roller 5 and the ink supplying roller 3 can be adjusted to a desired value by moving the ink coating roller 5 along the elongated grooves 6 with respect to the ink supplying roller 5.

When the stencil printing drum 1 turns counterclockwise in FIG. 1, the ink supplying roller 3 is turned counterclockwise around the rotary shaft 9. Ink supplied from an ordinary ink supplying means is supplied through the ink distributor 8 to the position near the region of the ink coating roller 5 and the ink supplying roller 3, thus forming the ink pool. In the printing operation, a rodshaped ink eddy is formed in the ink pool, and the ink 4 is applied to the ink supplying roller 3 by the ink coating roller 5. The ink 4 applied to the ink supplying roller 3 in this manner is supplied to the inner cylindrical surface of the rotary cylindrical drum 2.

The ink 4 forming the ink pool is prevented from flowing sideward by the ink banks 7. The guide surfaces b of the ink banks 7 are in contact with the cylindrical surfaces 10*a* of the cylindrical protrusions 10, respectively, and the ink leaking on the cylindrical protrusions 10 is returned to the ink pool by means of the sloped surfaces 11 of the ink banks 7 which are in contact with the side surfaces 10*b* of the ink supplying roller 3. That is, the ink 4 is never allowed to flow out of the ink supply range of the ink supplying roller 3. Hence, the difficulty is positively prevented that the printing machine or printing sheets are stained with the ink.

Figure 5:
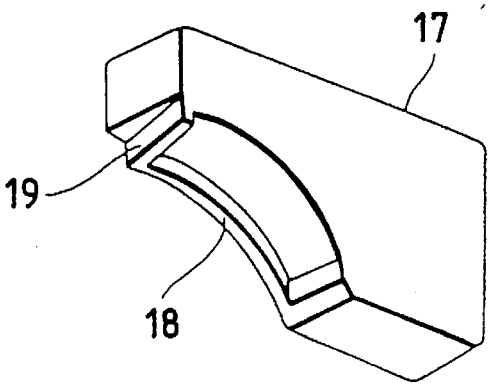
FIG. 5 is a perspective view of another embodiment of the ink bank.

FIG. 5 is a perspective view of another embodiment of the ink banks. In each of the above-described ink banks 7, its guide surface b brought into contact with the cylindrical protrusion 10 is one curved surface. On the other hand, in the ink bank 17 shown in FIG. 5, its part which is brought into contact with the cylindrical protrusion 10 of the ink supplying roller 3 is a protruded guide strip 18 small in width which meets the cylindrical surface of the cylindrical protrusion 10. The protruded guide strip 18 is smaller than the guide surface b (of the ink bank 7) in the area of contact with the cylindrical protrusion 10 and accordingly in frictional resistance. Hence, its load applied to the ink supplying roller is less. In FIG. 5, reference numeral 19 designates a sloped surface extended from the protruded guide strip. The sloped surface 19 functions in the same way as the above-described sloped surface 11.

The cylindrical protrusions 10 may be integrated with the ink supplying roller 3. Alternatively, the cylindrical protrusions 10 may be made separately from the ink supplying roller 3.

Preferably, the contact portion between the surface of the cylindrical protrusion 10 and the guide surface of the ink banks 7 may be made of a material that they resist frictional wear.

In the stencil printing drum of the invention, the cylindrical protrusions are extended from both ends of the ink supplying roller, respectively, which are smaller in outside diameter than the ink supplying roller, and the ink banks are set in contact with the cylindrical protrusions so that, when ink leaks on the cylindrical protrusions, the sloped surfaces of the ink bank lead the ink towards the middle of the ink supplying roller. Hence, with the stencil printing drum of the invention, the ink will never flow out of the ink supply range of the ink supplying roller, and therefore the printing machine and the printing sheets will never be stained with the ink.

What is claimed is:

1. A stencil printing machine comprises:

a rotary cylindrical drum having an ink passage part and being rotatable about a central axis;

an ink supplying roller rotatable around an ink supplying roller axis in parallel with the central axis of said rotary cylindrical drum, said ink supplying roller being moveable such that an outer surface thereof contacts an inner cylindrical surface of said rotary cylindrical drum;

an ink coating roller arranged in parallel with said ink supplying roller, said ink coating roller applying ink onto the surface of said ink supplying roller in accordance with said ink supplying roller rotating, an ink pool forming between said ink coating roller and said ink supplying roller;

a pair of cylindrical members respectively provided on opposite ends of said ink supplying roller, said cylindrical members having a smaller outside diameter than an outside diameter of said ink supplying roller and being coaxial with said ink supplying roller such that outer surfaces of said cylindrical members are displaced radially inwardly with respect to said outer surface of said ink supply roller; and a pair of ink banks provided at opposite ends of said ink pool, respectively, said ink banks including first surfaces which respectively contact said outer surfaces of said cylindrical members and second surfaces which intersect said first surfaces at respective leading edges along said outer surfaces of said cylindrical members, said second surfaces being angled with respect to said ink supplying roller axis such that ink which has leaked onto said outer surfaces of said cylindrical members is scraped by said leading edges and flows along said second surfaces back to said ink pool.

2. A stencil printing machine according to claim 1, wherein said second surfaces extend above the outer cylindrical surface of said ink supplying roller.

3. A stencil printing machine according to claim 2, wherein said ink supplying roller has side surfaces transverse to said ink supplying roller axis, said cylindrical members are respectively provided at said side surfaces, and said second surfaces are recessed into each said ink bank such that the depth of said recesses increases toward a corresponding one of said side surfaces of said ink supplying roller.

4. A stencil printing machine according to claim 1, wherein each of said ink banks further has a groove for slidably receiving said ink coating roller.

5. A stencil printing machine according to claim 1, wherein each of said ink banks further includes a protruding guide strip which contacts the cylindrical surface of said cylindrical member.

* * * * *